US007144246B2

(12) United States Patent
Barnstead

(10) Patent No.: US 7,144,246 B2
(45) Date of Patent: Dec. 5, 2006

(54) DECORATIVE CANDLE AND METHOD THEREFORE

(76) Inventor: Keith Barnstead, 530 Babylon Rd., Ambler, PA (US) 19002

( * ) Notice: Subject to any disclaimer, the term of this patent is extended or adjusted under 35 U.S.C. 154(b) by 0 days.

(21) Appl. No.: 11/028,276

(22) Filed: Jan. 3, 2005

(65) Prior Publication Data

US 2006/0147857 A1 Jul. 6, 2006

(51) Int. Cl.
*F23D 3/16* (2006.01)
*F23Q 2/32* (2006.01)

(52) U.S. Cl. ..... 431/126; 431/289

(58) Field of Classification Search ..... 431/289, 431/288, 126, 125, 325; 362/447, 161, 806; 44/275; 425/117

See application file for complete search history.

(56) References Cited

U.S. PATENT DOCUMENTS

| | | | | |
|---|---|---|---|---|
| 1,551,104 | A | | 8/1925 | Hawley |
| 1,576,205 | A | | 3/1926 | Mertens |
| 1,709,889 | A | | 4/1929 | Tasker |
| 2,300,226 | A | | 10/1942 | Ketchum |
| 3,286,492 | A | | 11/1966 | Frazier, Jr. |
| 3,294,888 | A | | 12/1966 | Lindahl |
| 4,225,552 | A | * | 9/1980 | Chang ..... 264/247 |
| 4,568,270 | A | * | 2/1986 | Marcus et al. ..... 431/288 |
| 5,519,077 | A | * | 5/1996 | Drewes et al. ..... 524/114 |
| 5,602,214 | A | * | 2/1997 | Lin et al. ..... 525/478 |
| 5,632,615 | A | * | 5/1997 | DeGarmo ..... 431/288 |
| 5,944,509 | A | * | 8/1999 | Masters et al. ..... 431/288 |
| 6,669,464 | B1 | | 12/2003 | Lin et al. |

OTHER PUBLICATIONS

Yaley Enterprises, Inc.; Designer Candles for All Occasions; 1999; Prolific Impressions, Inc.; p. 12.*
Terry Taylor, Decorating Candles, 2001, Lark Books, pp. 96-97.*
C. Kaila Westerman; Gel Candles: 40 Creative Projects; 2001; Storey Publishing, LLC; pp. 124-125.*

* cited by examiner

*Primary Examiner*—Cheryl Tyler
*Assistant Examiner*—Michael J. Early
(74) *Attorney, Agent, or Firm*—Michael Crilly, Esq.

(57) ABSTRACT

A candle with conformal polymer ornaments providing the appearance of an intricately carved candle is presented. The candle body has a plurality of cavities along its exterior surface and directly beneath each ornament. Adhesive is provided between the candle body and conformal ornaments and fills the cavities within the candle body. Ornaments are fixed to the candle via adhesive and mechanical bonds between each conformal ornament and the candle body.

17 Claims, 5 Drawing Sheets

DECORATIVE CANDLE AND METHOD THEREFORE

CROSS REFERENCE TO RELATED APPLICATIONS

None.

FEDERALLY SPONSORED RESEARCH OR DEVELOPMENT

None.

BACKGROUND OF THE INVENTION

1. Field of the Invention

The present invention generally relates to a candle having thereon a conformal ornament with a decorative design so as to appear to be an intricately carved candle. The ornament is adhesively fastened to the candle, as well as mechanically fastened thereto via a plurality of adhesive-filled cavities along the candle beneath the ornament.

2. Background

The related arts include a variety of decorative candles.

Hawley, U.S. Pat. No. 1,551,104, describes and claims a jeweled candle. The candle includes solid jewel members set into the candle so as to be mechanically locked therein.

Mertens, U.S. Pat. No. 1,576,205, describes and claims a candle and method therefore. The candle includes a two-dimensional painted design applied to the outer surface of the candle. An adhesive layer is applied over the painted design so as to adhere crystals or similar materials above the painted design.

Tasker, U.S. Pat. No. 1,709,889, describes and claims a decorative candle and method therefore. The candle includes a two-dimensional decorative material contacting the outer surface of the candle and having an outer coating over both candle and decorative material.

Ketchum, U.S. Pat. No. 2,300,226, describes and claims a candle holder. The candle includes an ornamental element mechanically fastened to the candle via a threaded bolt or screw passing completely through the candle.

Frazer, U.S. Pat. No. 3,286,492, describes and claims a candle novelty. The invention includes a votive candle residing within a translucent holder and having a thin film therebetween. The film has a message thereon which is made visible when the candle is lit.

Lindahl, U.S. Pat. No. 3,294,888, describes and claims a method for manufacturing a decorative candle. The process bonds a raised or embossed wax-based decoration to the exterior of a wax-based candle. The bond method is a melt-based fusion process.

Chang, U.S. Pat. No. 4,225,552, describes and claims a method for manufacturing a decorative candle. The candle includes a plurality of decorative wax ornaments encased within the structure of the candle.

Lin et al., U.S. Pat. No. 6,669,464 B2, describes and claims a holiday ornament-candle apparatus. The ornament is mechanically coupled to the candle and released after the candle wax melts.

The related arts fail to teach a decorative candle with three-dimensional ornamentation consisting of a polymer-based ornament attached to the exterior of a wax-based candle and having the appearance of an intricately carved candle. Furthermore, the related arts describe and claim candle inventions that either consume or dislodge the decorative ornament as the wick burns and candle melts.

Therefore, what is required is a candle having at least one ornament attached thereto that does not burn, melt or dislodge as the wick burns and candle melts.

Furthermore, what is required is a decorative candle wherein surface ornamentation includes a three-dimensional polymer ornament appearing to be intricately carved within the candle and composed of candle wax.

Furthermore, what is required is a decorative candle wherein surface ornamentation includes one or more colors appearing to be intricately carved within the candle and composed of candle wax.

SUMMARY OF THE INVENTION

An object of the present invention is to provide a candle having at least one ornament attached thereto that does not burn, melt, or dislodge as the wick burns and candle melts.

Another object of the present invention is to provide a decorative candle having a three-dimensional polymer ornament that appears to be intricately carved within the candle and composed of candle wax.

Another object of the present invention is to provide a decorative candle having a polymer ornament with a variety of colors that appears to be intricately carved within the candle and composed of candle wax.

The present invention includes a candle body having a wick therein, a conformal ornament, and an adhesive layer. The wick is composed of a material that burns in a controlled fashion so as to produce a glow within the candle body. The candle body melts within a limited region about the wick. The candle body has an exterior surface with a plurality of cavities therein. The conformal ornament is sufficiently transmissive so as to allow the glow within the candle body to pass there through. The adhesive layer is disposed between the exterior surface and conformal ornament and fills cavities within the candle body beneath the conformal ornament. In preferred embodiments, the adhesive layer bonds and mechanically fastens the conformal ornament to the candle body. The adhesive layer is likewise sufficiently transmissive so as to allow the glow within the candle body to pass there through. In alternate embodiments of the present invention, a plurality of one-piece or two piece-two fasteners are used to mechanically fasten the conformal ornament to the candle body.

Four advantages are afforded by the present invention. The invention provides a uniquely decorative item whereby backlighting accentuates the design and colors within a three-dimensional conformal ornament attached to the exterior of the candle. The invention greatly reduces the manufacturing cost of intricately ornamented glow candles. The invention greatly increases the complexity and variety of colors within the surface design of a candle, while maintaining the appearance of a carved candle. The invention eliminates skilled labor otherwise required to carve intricate surface ornamentation.

BRIEF DESCRIPTION OF THE DRAWINGS

The invention will now be described in more detail, by way of example only, with reference to the accompanying drawings, in which.

REFERENCE NUMERALS

Figure 1:
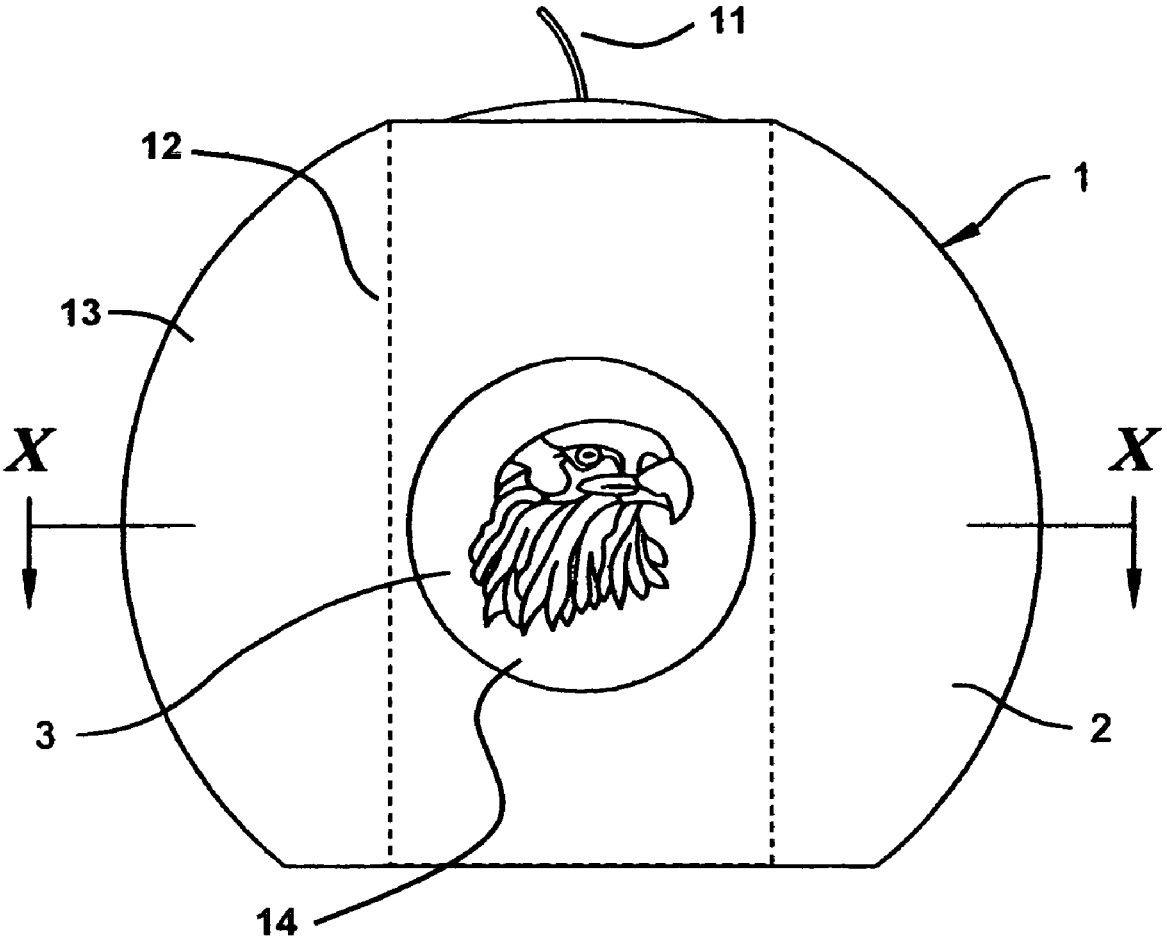
FIG. 1 is a side elevation view of an exemplary embodiment of a decorative candle comprising a globe-shaped candle body and having a conformal ornament attached thereto.

1 Decorative candle
2 Candle body
3 Conformal ornament
4*a*–4*c* Cavities
5 Adhesive layer
6*a*–6*c* One-piece fastener
7*a*–7*c* Fastener
8*a*–8*c* Anchor
9 Recess
10 Fastener head
11 Wick
12 Melt region
13 Exterior surface
14 First side
15 Second side
16*a*–16*c* Two-piece fastener

DESCRIPTION OF THE INVENTION

The present invention relates to a decorative candle 1 including a candle body 2 and a conformal ornament 3. FIGS. 1–5 describe the present invention and variations thereof. While globe-shaped candles are described, other candle shapes are possible, including, without limitation, cylinders, pyramids, and rectangular solids.

Referring now to FIG. 1, a candle body 2 is shown having a conformal ornament 3 attached thereto. The conformal ornament 3 is shown with a generally circular shape, although a variety of other shapes are possible, including, without limitation, standard geometric shapes and complex designs. The conformal ornament 3 is also shown having the ornamental design of an eagle. However, an infinite number of designs and shapes may reside on the conformal ornament 3, including, without limitation, company logos, organization logos, trademarks, commemorative designs, holiday designs, portraits, words, and phrases.

The candle body 2 is composed of a wax-based material having a wick 11 disposed along a generally vertical axis. The wick 11 is composed of a material capable of supporting a flame that slowly consumes the wick 11. A variety of candle body 2 and wick 11 materials are known within the art.

Figure 2:
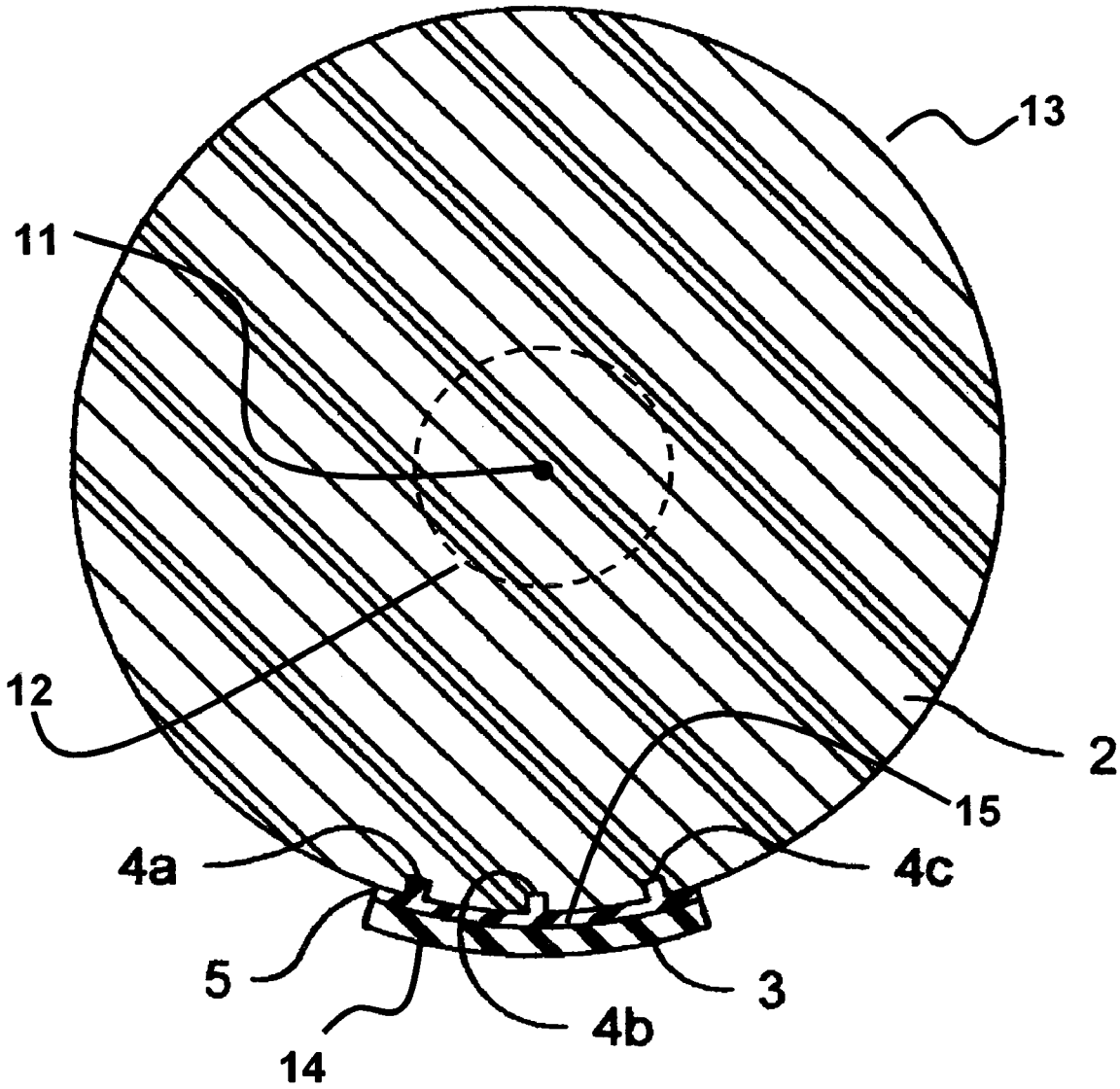
FIG. 2 is a section view of the candle in FIG. 1 showing an adhesive layer between candle body and conformal ornament wherein the adhesive layer fills a plurality of cavities within the candle beneath the ornament.

The candle body 2 slowly melts within a melt region 12 of limited extent about the wick 11 so as to retain the overall shape of the decorative candle 1 and to prevent the conformal ornament 3 from melting or otherwise being consumed by the burning wick 11. For example, the candle body 2 in FIGS. 1–2 shows the melt region 12 as a cylindrical-shaped region traversing the depth of the candle body 2 and having a generally circular form about the wick 11. While various dimensional constraints are possible, it was found that a 4-inch diameter globe having a melt region 12 with a diameter less than 2-inches was sufficient to preserve the decorative features of the candle during use. The limited melt region 12 described herein extends the lifetime of the decorative candle 1 by enabling the use of a tea light or votive candle within the melt region 12 of the candle body 2 after the wick 11 has been nearly completely consumed.

While the candle body 2 may be composed of various wax-based materials known within the art, it was preferred for the candle body 2 to glow so as to effectively couple light from the burning wick 11 into and through the conformal ornament 3. As such, it was desired for the wax composition to include a titanium dioxide or similar glow enhancing fill, as would be understood in the art. In other embodiments, it may be desired to over dip the candle body 2 with one or more non-transmissive colored waxes or pigments so as to better couple the glow within the candle body 2 into the conformal ornament 3.

The conformal ornament 3 is a decorative item generally planar in extent and having a first side 14 with an ornamental design thereon, as shown in FIG. 1, and a second side 15 that contacts an adhesive layer 5, as shown in FIG. 2. The conformal ornamental 3 may be composed of a flexible polymer that conforms to the shape of the exterior surface 13 when pressed against the candle body 2. While a variety of flexible polymers may be applicable to the present invention, a flexible PVC composition nearly identical in color to the candle body 2 was preferred. It is likewise possible for the conformal ornament 3 to be composed of a rigid polymer material approximating the profile of the exterior surface 13 and colored to nearly match the color of the candle body 2. It was also required for the conformal ornament 3 to be composed of a polymer material that was either translucent or transparent so as to communicate the glow or backlighting from the candle body 2. Conformal ornaments 3 may be manufactured via known techniques including injection molding and extrusion.

A decorative design is provided on the first side 14 of the conformal ornament 3, as represented in FIG. 1. The decorative design may include a raised three-dimensional image that extends above or into the conformal ornament 3. It is likewise possible for the conformal ornament 3 to be a uniform thickness polymer element with surface designs and/or wording thereon. It is likewise possible for the decorative design to include one or more ornamental colors to further accentuate the decorative design under normal light conditions and/or when backlit by the glow communicated through the candle body 2.

The conformal ornament 3 must properly match and maintain the shape of the candle body 2 so as to give the appearance of an intricately detailed image carved into the candle body 2 and to efficiently couple light from the burning wick 11 into and through the conformal ornament 3. As such, the conformal ornament 3 must be both adhesively and mechanically coupled to the candle body 2.

Referring now to FIG. 2, a section view of the candle body 2 shows one possible arrangement to properly attach a polymer-based conformal ornament 3 to the wax-based candle body 2. A plurality of cavities 4*a*–4*c* are either mechanically drilled or molded into the candle body 2 within the region beneath the conformal ornament 3, as represented in FIG. 2. Cavities 4*a*–4*c* may include a variety of shapes and dimensions. For example, cavities 4*a*–4*c* may be cylindrically shaped and have a diameter of 0.125-inches and a depth-to-diameter ratio of approximately 2, although other ratios are possible. An adhesive layer 5 is disposed on the candle body 2 adjacent to the cavities 4*a*–4*c* so as to cover the exterior surface 13 and fill the cavities 4*a*–4*c* beneath the conformal ornament 3. The conformal ornament 3 is pressed onto the adhesive layer 5 so as to contact the second side 15 and ensure cavities 4*a*–4*c* are completely filled with adhesive. It may be required to apply pressure onto the conformal ornament 3 during the duration of the cure cycle of the adhesive.

While various commercially available adhesive compositions are applicable to the present invention, it was desired for the adhesive to exhibit some shrinkage during cure and to form a flexible and durable bond layer between the conformal ornament 3 and candle body 2. It was also required for the adhesive to be either translucent or transparent so as to communicate the glow or backlighting from the candle body 2. One exemplary adhesive is GE SILICONE II, a methyldimethoxy-polydime-siloxane-based composition, sold by the General Electric Company, which was sufficient to adhere either a 0.063-inch thick or a 0.125-inch thick PVC-based conformal ornament 3 onto a candle body 2 composed of paraffin and titanium dioxide. However, other candle compositions and formulations are possible.

While not intending to be bound by theory, the adhesive is believed to adhesively bond to both conformal ornament 3 and exterior surface 13. It is likewise believed that the adhesive forms a mechanical interlock between conformal ornament 3 and cavities 4*a*–4*c*, which is accentuated by shrinkage of the adhesive during its cure cycle.

Figure 3:
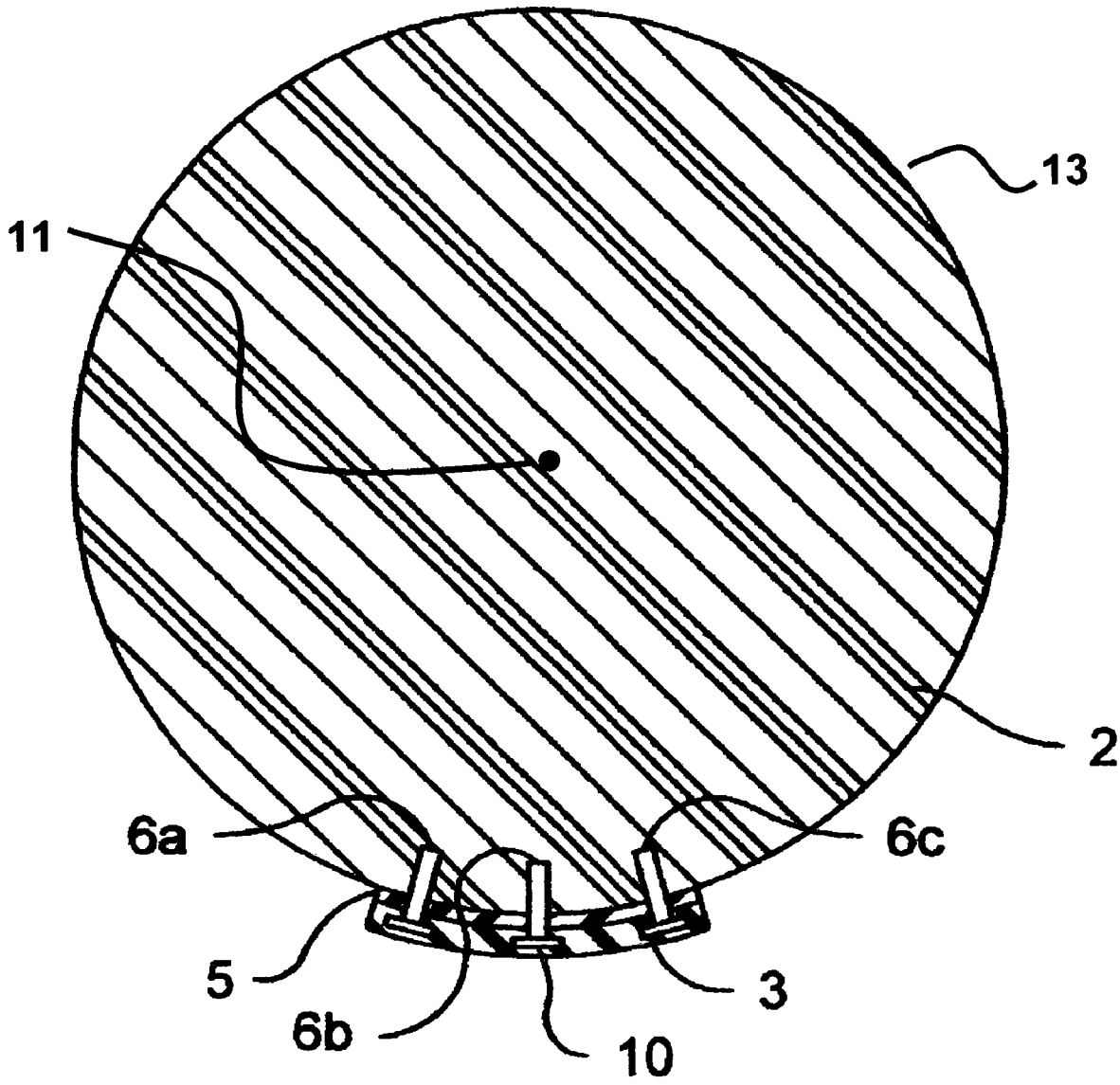
FIG. 3 is a section view of the candle in FIG. 1 showing an adhesive layer between candle body and conformal ornament and several one-piece fasteners embedded within the ornament and fastened to the candle body.
Figure 4:
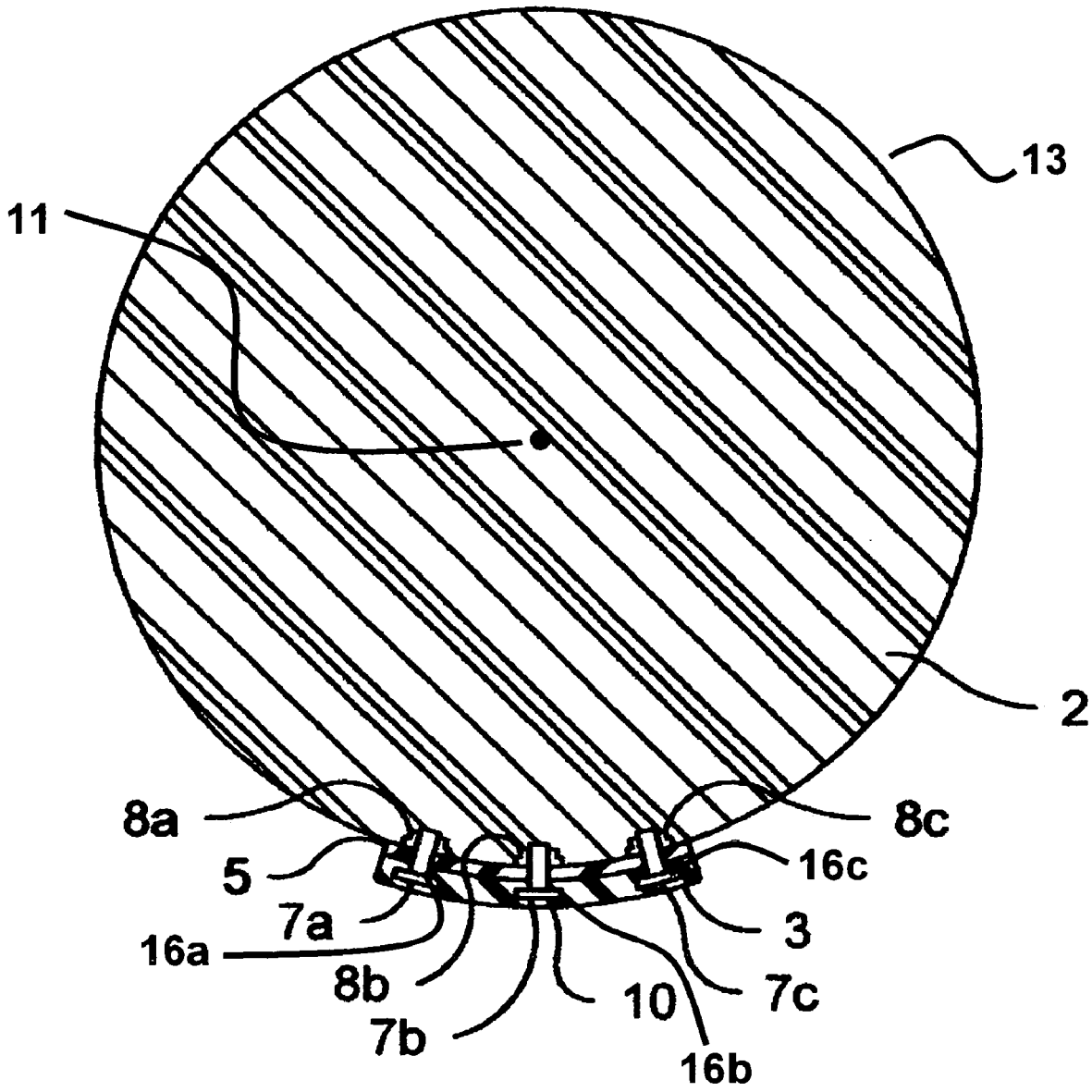
FIG. 4 is a section view of the candle in FIG. 1 showing an adhesive layer between candle body and conformal ornament and several two-piece fasteners wherein a first piece is partially embedded within the ornament and a second piece is embedded within the candle and both first and second pieces are mechanically interlocked.

In some embodiments, it may be desired to adhesively bond the conformal ornament 3 to the candle body 2, as described above, and to mechanically lock the conformal ornament 3 to the candle body 2 via a fastener. One-piece fasteners 6*a*–6*c* and two-piece fasteners 16*a*–16*c* described below may be composed of a polymer that is either translucent or transparent so as to communicate the glow or backlighting from the candle body 2. Although three fasteners are shown in FIGS. 3–4, the present invention may include one or more such elements or combinations thereof Referring now to FIG. 3, a conformal ornament 3 is shown attached to a candle body 2 via an adhesive layer 5 and a plurality of one-piece fasteners 6*a*–6*c*. One end of each one-piece fastener 6*a*–6*c*, otherwise identified as the fastener head 10, is attached to the conformal ornament 3 either via an adhesive bond or mechanically attached by embedding the fastener head 10 within the conformal ornament 3, as shown in FIG. 3. The opposite end of each one-piece fastener 6*a*–6*c* is pushed into a cavity 4*a*–4*c* within the candle body 2 and thereby secured therein. While a variety of one-piece fasteners 6*a*–6*c* may be applicable to the present invention, self-locking fasteners were preferred, one example being a PINE-TREE CLIP, a fastener having a flat head and a ribbed shaft projecting from one side of the flat head in a perpendicular arrangement, sold by ITW Fastex, located in Des Plaines, Ill.

Referring now to FIG. 4, a conformal ornament 3 is shown attached to a candle body 2 via an adhesive layer 5 and a plurality of two-piece fasteners 16*a*–16*c*. One end of each fastener 7*a*–7*c*, otherwise identified as the fastener head 10, is attached to the conformal ornament 3 either via an adhesive bond or mechanically attached by embedding the fastener head 10 within the conformal ornament 3, as shown in FIG. 4. Each anchor 8*a*–8*c* is embedded within the candle body 2, preferably so that each resides within a cavity 4*a*–4*c*, and flush with the exterior surface 13, also shown in FIG. 4. Anchors 8*a*–8*c* may be embedded within the candle body 2 during manufacture of the candle, while the wax is soft or some time thereafter. During assembly, the conformal ornament 3 is pressed onto the adhesive layer 5 and each fastener 7*a*–7*c* is mechanically locked with a corresponding anchor 8*a*–8*c*. Pressure should be applied across the conformal ornament 3 during the cure cycle of the adhesive so as to avoid gaps between conformal ornament 3 and candle body 2. While a variety of two-piece fasteners 16*a*–16*c* may be applicable to the present invention, rivet-type fasteners were preferred, examples including TUFLOK, a fastener with a pre-driven head, and snap rivet, both sold by ITW Fastex, located in Des Plaines, Ill.

Figure 5:
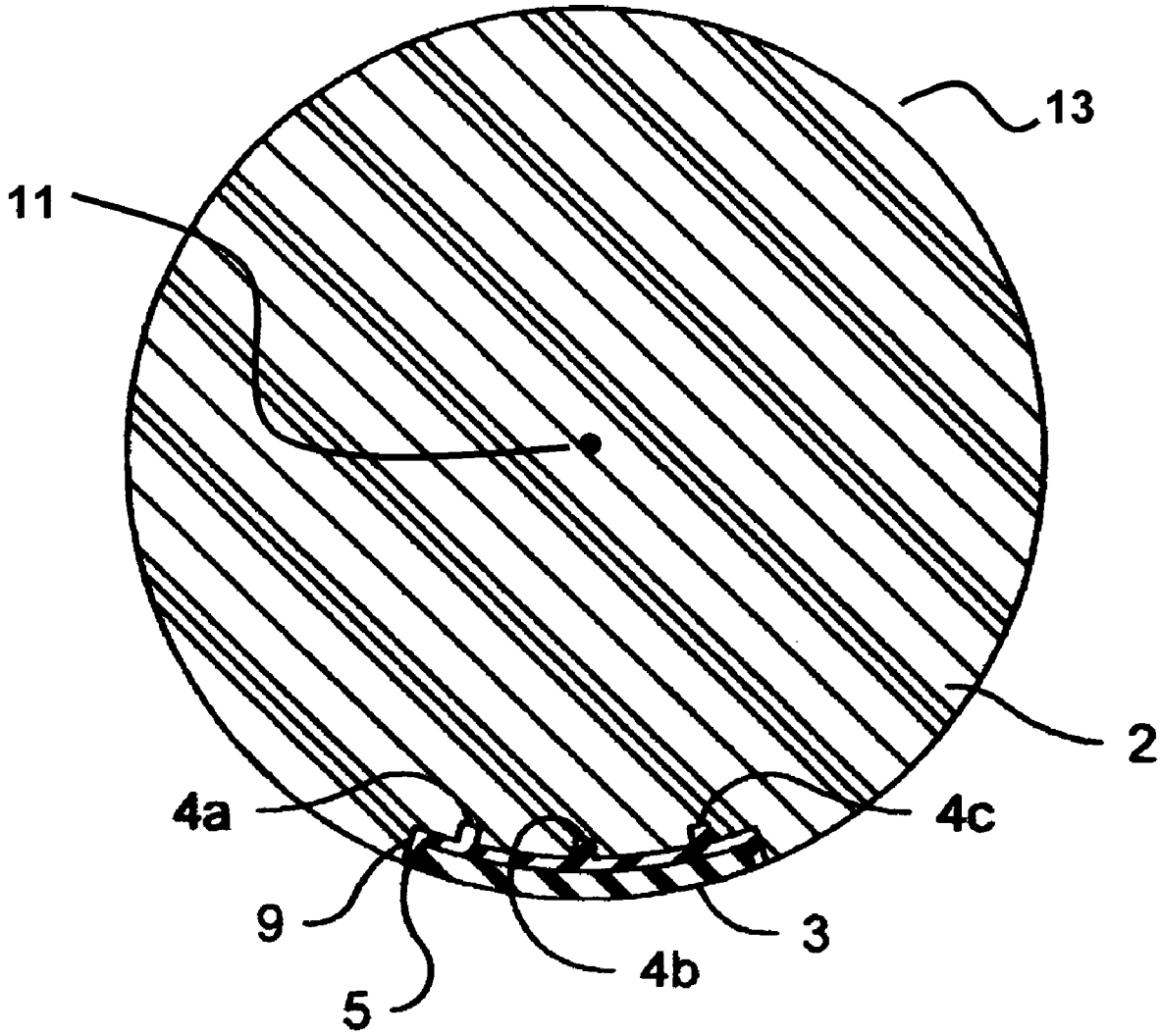
FIG. 5 is a section view of the candle in FIGS. 1–2 showing an alternate embodiment wherein the conformal ornament is recessed within the candle body.

Referring now to FIG. 5, it may be desired in some embodiments to have the conformal ornament 3 recessed within the candle body 2. In such embodiments, the conformal ornament 3 is fastened within a recess 9 so that the conformal ornament 3 is nearly flush with the exterior surface 13 of the candle body 2. The recess 9 is typically carved into the candle body 2, via techniques understood in the art, shortly after the candle body 2 is formed. Adhesive may be applied about the perimeter of the conformal ornament 3 to lock the conformal ornament 3 within the candle body 2. An adhesive layer 5 between conformal ornament 3 and candle body 2 may include adhesive within cavities 4*a*–4*c*, as represented in FIG. 5. It is likewise possible for the described recess 9 to be used with the fastener embodiments in FIGS. 3–4.

Candle bodies 2 and conformal ornaments 3 are separately manufactured and thereafter assembled to form the decorative candles 1 described herein. For example, it was preferred to apply the adhesive layers 5 in FIGS. 2–5 onto the exterior surface 13 of the candle body 2 via a small brush so as to fill cavities 4*a*–4*c* within the candle body 2 and form a uniform thickness adhesive layer 5 there above. After proper application of the adhesive layer 5, the conformal ornament 3 was pressed onto the adhesive layer 5. Excess adhesive may be smoothed or removed from the perimeter of the conformal ornament 3 via a brush or knife. A weight or similar compressive device may be applied onto the conformal ornament 3 during the cure cycle of the adhesive so as to avoid gaps between the conformal ornament 3 and exterior surface 13.

As described above, it was preferred to also fasten the conformal ornaments 3 to the candle body 2. The described method of manufacture would also include fastening the conformal ornament 3 via a self-locking, one-piece fastener 6*a*–6*c* to each cavity 4 within the candle body 2. In yet other embodiments, the fastening step included securing fasteners 7*a*–7*c* to the conformal ornament 3, securing anchors 8*a*–8*c* to the candle body 2 and thereafter mechanically interlocking fasteners 7*a*–7*c* and anchors 8*a*–8*c*.

The description above indicates that a great degree of flexibility is offered in terms of the present invention. Although the invention has been described in considerable detail with reference to certain preferred versions thereof, other versions are possible. Therefore, the spirit and scope of the appended claims should not be limited to the description of the preferred versions contained herein.

What is claimed is:

1. A decorative candle comprising:

(a) a wax candle body of non-planar extent, said wax candle body having a wick therein, said wick burns so as to produce a glow within said wax candle body, said wax candle body having a melt region of limited extent about said wick, said wax candle body having an exterior surface with a plurality of cylindrically-shaped cavities thereon;

(b) a conformal polymer ornament of generally planar extent, flexible, and transmissive of said glow, said cylindrically-shaped cavities dimensionally smaller than and beneath said conformal polymer ornament, said conformal polymer ornament conforming to said exterior surface when pressure is applied to said conformal polymer ornament; and (c) a liquid silicone adhesive disposed between said wax candle body and said conformal ornament, said liquid silicone adhesive filling said cylindrically-shaped cavities beneath said conformal ornament, said liquid silicone adhesive forming a resilient solid between said conformal polymer ornament and said wax candle body, said liquid silicone adhesive between said exterior surface and said conformal polymer ornament adhesively bonding said conformal polymer ornament to said wax candle body, said conformal polymer ornament mechanically interlocked to said wax candle body by said liquid silicone adhesive within said cylindrically-shaped cavities, said liquid silicone adhesive transmissive of said glow.

2. The decorative candle of claim 1, wherein said wax candle body having a composition that enhances said glow.

3. The decorative candle of claim 1, wherein said conformal ornament is comprised of a flexible PVC.

4. The decorative candle of claim 1, wherein said conformal ornament is recessed within said wax candle body.

5. A decorative candle comprising:

(a) a candle body having a wick therein, said wick burns so as to produce a glow within said candle body, said candle body having a melt region of limited extent about said wick, said candle body having an exterior surface with a plurality of cavities thereon;

(b) a conformal ornament transmissive of said glow;

(c) a plurality of fasteners attached at a first end to said conformal ornament and at a second end within said cavities; and (d) an adhesive disposed between said candle body and said conformal ornament, said adhesive transmissive of said glow.

6. The decorative candle of claim 5, wherein said candle body having a composition that enhances said glow.

7. The decorative candle of claim 5, wherein said conformal ornament is composed of a flexible PVC.

8. The decorative candle of claim 5, wherein said adhesive is composed of silicone.

9. The decorative candle of claim 5, wherein said conformal ornament is recessed within said candle body.

10. A decorative candle comprising:

(a) a candle body having a wick therein, said wick burns so as to produce a glow within said candle body, said candle body having a melt region of limited extent about said wick, said candle body having an exterior surface with a plurality of cavities thereon;

(b) a conformal ornament transmissive of said glow;

(c) a plurality of fasteners each having a first piece and a second piece, each said first piece partially embedded within said conformal ornament, each said second piece embedded within one said cavity, each said first piece mechanically locking with one said second piece; and (d) an adhesive disposed between said candle body and said conformal ornament, said adhesive transmissive of said glow.

11. The decorative candle of claim 10, wherein said candle body having a composition that enhances said glow.

12. The decorative candle of claim 10, wherein said conformal ornament is composed of a flexible PVC.

13. The decorative candle of claim 10, wherein said adhesive is composed of silicone.

14. The decorative candle of claim 10, wherein said conformal ornament is recessed within said candle body.

15. A method of fabricating a decorative candle comprising the steps of:

(a) applying an adhesive onto an exterior surface of a candle body;

(b) applying said adhesive into a plurality of cavities within said candle body; and (c) pressing a flexible ornament onto said adhesive along said exterior surface above said cavities until said adhesive is cured.

16. The method of claim 15, further comprising the step of:

(d) fastening said conformal ornament to said candle body via a plurality of one-piece fasteners.

17. The method of claim 15, further comprising the step of:

(d) fastening said ornament to said candle body via a plurality of two-piece fasteners.

* * * * *

UNITED STATES PATENT AND TRADEMARK OFFICE

CERTIFICATE OF CORRECTION

PATENT NO. : 7,144,246 B2
APPLICATION NO. : 11/028276
DATED : December 5, 2006
INVENTOR(S) : Keith Barnstead It is certified that error appears in the above-identified patent and that said Letters Patent is hereby corrected as shown below:

Columns 7 and 8
Delete Claims 5-14, 16, and 17

Column 8, Claim 15
Delete "15."; insert --5.--

Signed and Sealed this

Fifteenth Day of January, 2008

JON W. DUDAS
*Director of the United States Patent and Trademark Office*